US005675960A

United States Patent [19]

Weaver

[11] Patent Number: 5,675,960

[45] Date of Patent: Oct. 14, 1997

[54] EMBOSSED TRAYS FOR MULTIPACK PALLET STOCK STACKABILITY

[75] Inventor: William N. Weaver, Northbrook, Ill.

[73] Assignee: Illinois Tool Works Inc., Glenview, Ill.

[21] Appl. No.: 579,303

[22] Filed: Dec. 27, 1995

[51] Int. Cl.[6] ..... B65B 17/02; B65B 47/04; B65B 61/02

[52] U.S. Cl. ..... 53/397; 53/141; 53/398; 53/443; 53/462; 206/427; 206/503; 206/821

[58] Field of Search ..... 53/397, 398, 48.1, 53/48.3, 462, 453, 447, 443, 157, 207, 141; 206/501, 503, 564, 427, 821; 493/339, 338, 964, 965, 464, 467, 902, 901, 58, 59, 61, 185; 414/902, 922, 923, 267, 789.5; 229/915

[56] References Cited

U.S. PATENT DOCUMENTS

| | | | |
|---|---|---|---|
| 3,855,756 | 12/1974 | Sweeney et al. | 53/447 X |
| 3,949,876 | 4/1976 | Bridges et al. | 206/503 X |
| 3,979,882 | 9/1976 | Howe | 53/462 X |
| 4,155,451 | 5/1979 | Miller | 206/503 |
| 5,184,748 | 2/1993 | Apps | 206/503 X |
| 5,427,242 | 6/1995 | Oliff et al. | 206/821 X |

*Primary Examiner*—James F. Coan

*Attorney, Agent, or Firm*—Thomas W. Buckman; John P. O'Brien; Donald J. Breh

[57] ABSTRACT

A method for creating a stable, palletized unit of trays of multipackaged containers. The containers are multipackaged with a flexible ring-type plastic device. The trays are of corrugated paperboard which have been pre-compressed or embossed in predetermined areas of the base of the tray so that any tendency of the tray to compress under pressure from the base of the containers during a palletization is avoided.

4 Claims, 4 Drawing Sheets

EMBOSSED TRAYS FOR MULTIPACK PALLET STOCK STACKABILITY

BACKGROUND OF THE INVENTION

This invention relates to improvements in the manufacture and assembly of packaging for handling and distribution of cans which have been multipackaged through the use of ring carriers. More particularly, for improvements in folding cut and corrugated trays that assist in the handling and distribution of such packaging.

Generally the distribution packages referred to above are created by assembling a flexible polyethylene carrier at the rim or in the chime area of cans. Such carrier is typically shown in U.S. Pat. No. 4,219,117. With the continued advancement and modification in can manufacturing, the diameter of the lid of cans is becoming increasingly smaller relative to the diameter of the body. In doing so, thus created multipackaged cans have a tendency to permit the cans to independently move along their central axis relative to the other cans in such a multipackage. This movement is in and of itself is not a problem or detrimental. However, when these multipackages are then grouped and assembled in larger arrays of packages, for example in 4–6 six packs in a relatively low walled corrugated paperboard tray for distribution purposes, such corrugated trays have wall sections and bay sections that are compressible and thus are capable of changing thicknesses under pressure. When the containers assembled in the multipackaging are placed in these trays, they then are palletized for storage and ultimate shipment. Such a pallet typically involves at least 8 layers of approximately 7–8 trays and can be stacked up to three pallets high.

Certain conditions could create a selective crushing or compression of select areas of the board trays. Which in the highly stacked and arrayed palletized condition could in many situations create an unstable pallet or succession of pallets by permitting or forcing a stack of packages to lean from a vertical axis. Once the lean starts, the distribution of forces creates further force on the side or area of the stack that is leaning. The fact that the individual six packs are constructed in such a way that individual cans may move axially relative to one another rather than having a unitized six pack exasperates this potential problem.

The present invention presents an improved approach to creating such an array of stable palletized packages.

SUMMARY OF THE INVENTION

The present invention is a method for pre-compressing corrugated trays in select regions that would ultimately receive the bottoms of cans that would thereby enable the creation of a stable, palletized unit of trays of multipackaged containers, therefore any tendency of the corrugated trays to compress under pressure from the bottoms of the cans during and after palletization is avoided.

DETAILED DESCRIPTION OF PREFERRED EMBODIMENTS

Figure 1:
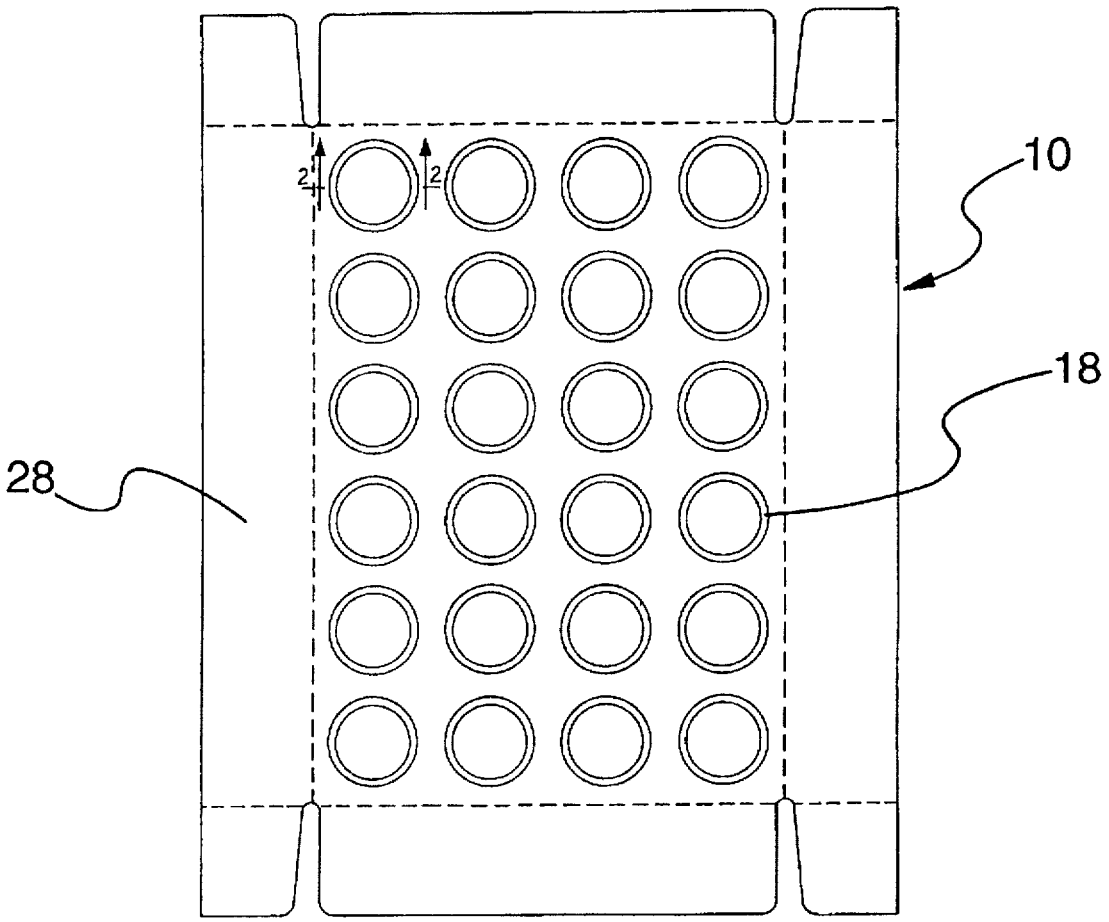
FIG. 1 is a top plan view of a corrugated carton board tray prior to assembling or folding of the walls to form the tray.
Figure 2:
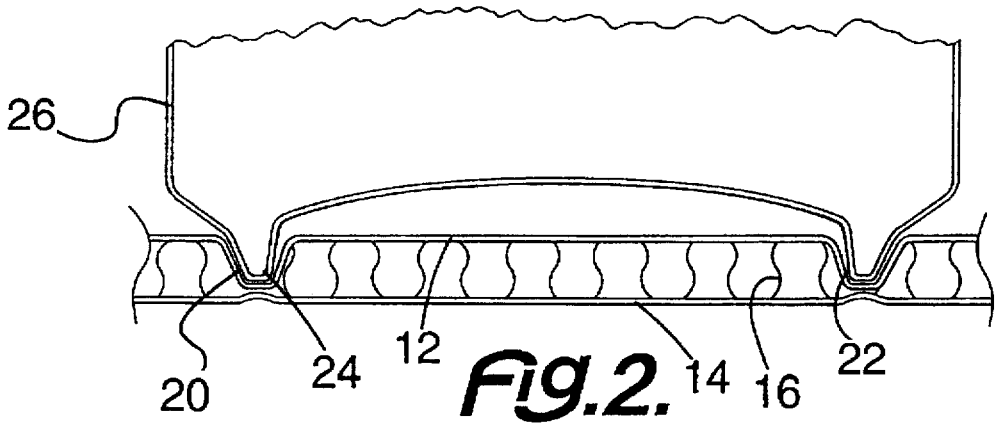
FIG. 2 is an enlarged partial cross-sectional view taken along line 2—2 of FIG. 1 in the direction indicated by the arrows and further showing the position of containers within the tray.

Referring now to FIGS. 1 and 2 will be shown that corrugated paperboard 10 which typically made of a sandwich of material comprising a top thin sheet of paper 12 and a bottom thin sheet of paper 14 sandwiching a corrugated intermediate section 16. Such construction is standard and is widely used in the packaging industry.

Figure 3:
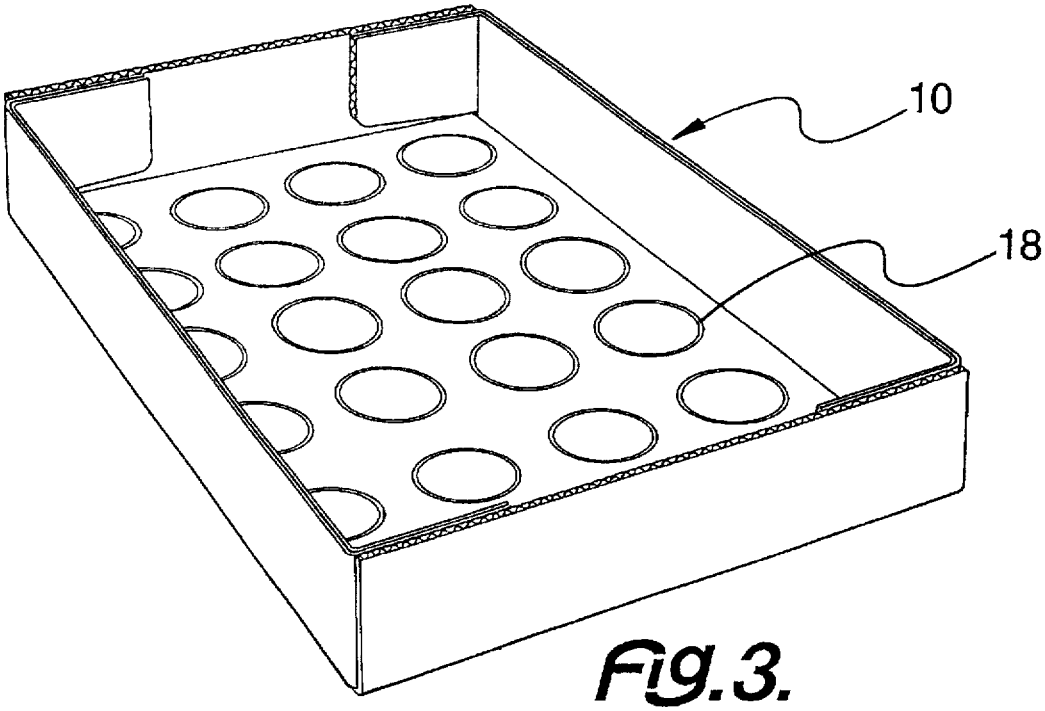
FIG. 3 is a perspective view of one of the distribution packages constructed by the trays of FIGS. 1 and 2.

FIGS. 1, 2 and 3 further show how a pre-compression from a rolling or reciprocating die creates pre-compressed rings 18 (FIGS. 1 and 3) within regions 20, 22 (FIG. 2) of the corrugated board particularly in the base of the tray. These regions show a substantially decreased thickness of board and will for all practical purposes create a section that will be insensitive to further compression after initial pallet loading and stacking. As shown in FIG. 2, each pre-compressed ring is sized to accept a base 24 of a can 26 in a predetermined location thereby preventing further compression of the corrugated material 16 and also prevents the movement of the can on the tray.

Excellent results are obtained when the top thin sheet of paper 12 of the corrugated board is compressed towards the bottom thin sheet of paper 14 leaving the bottom thin sheet of paper substantially flat or having a slight indentation, as can be seen in FIG. 2.

Compressing the top thin sheet of paper and intermediate corrugated section 16 in accordance with this invention, locally damages the corrugated section so it can no longer support the cans without depressing the area as shown in FIG. 2. This configuration leaves the bottom sheet of paper substantially flat when stacked on top of other trays of containers. Therefore upon moist or humid conditions, coupled with forces asserted on the trays from the cans and from the combined pressure of cans of trays above each successive layer, this designed pre-compression minimizes the undesired uncontrolled compression of the corrugated tray.

The side walls are upwardly and inwardly folded as well as adhesively secured to each other to form a tray with four side walls. While a tray with side walls is shown, it should be understood that the present invention could be incorporated in a sheet of corrugated paperboard without side walls.

Figure 4:
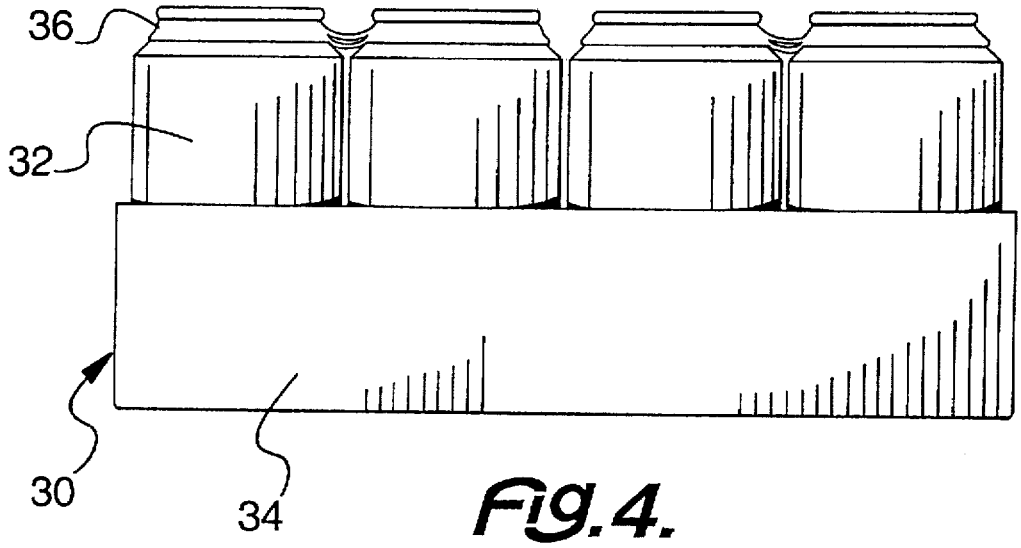
FIG. 4 is a side elevational view of one of the distribution packages constructed by the trays of FIGS. 1, 2 and 3.

Such a package then shown in FIG. 4 is a typical distribution package 30 using the invention wherein four six-packs of beer or beverage canisters 32 held together by a flexible ring carrier 36 are packaged into a pre-compressed tray 34 so that a route or delivery driver can immediately move the multipackages into retail stores.

Figure 5:
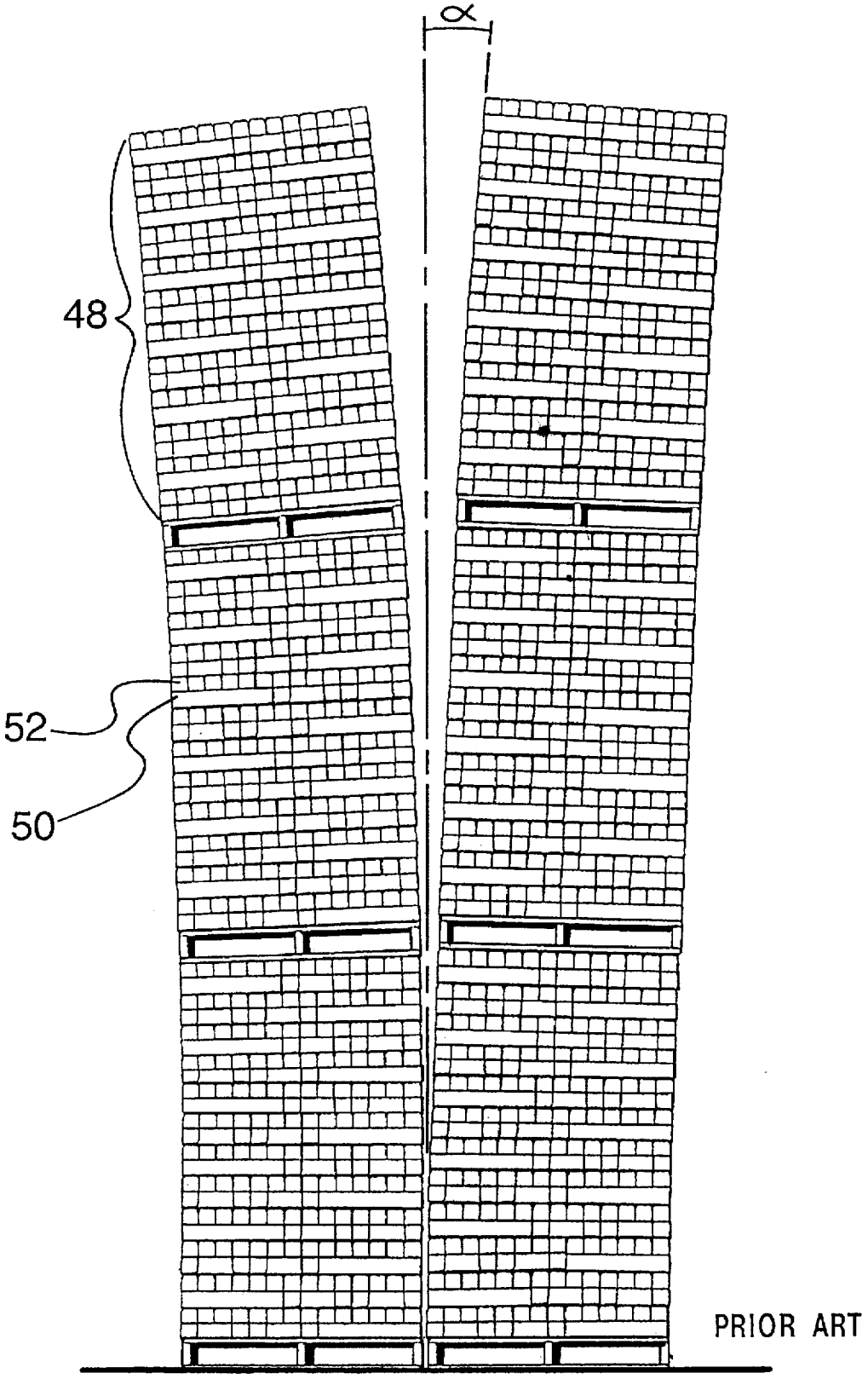
FIG. 5 is a stack of prior art palletized trays illustrating the problems encountered therewith.
Figure 6:
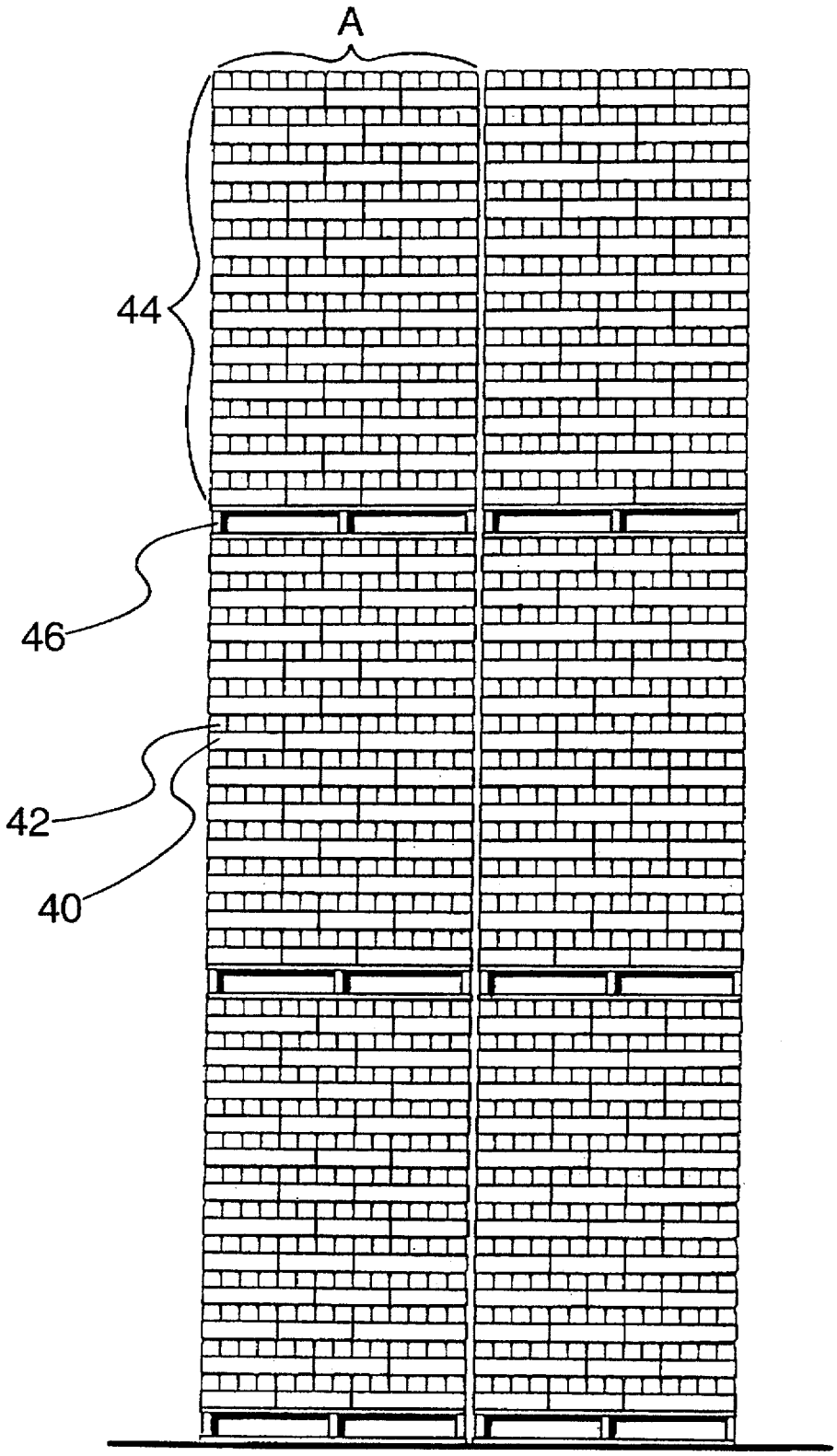
FIG. 6 is a stack of palletized trays illustrating the use of the pre-compressed trays of the present invention.

Consistent with the prior art handling, these trays are stacked not only in layers of at least seven cases or trays, but the distribution packages of trays are arranged in palletized loads such as shown in FIG. 6 that typically is at least 8 layers high on each pallet (12 layers shown). Each layer consists of a pre-compressed tray 40 packaged with beverage containers 42. FIG. 6 shows a series of palletized loads 44 closely spaced to one another in the form of 2 rows. For example, Row A, three palletized loads are stacked one on top of each other. Each palletized load 44 is stacked on a pallet or a skid 46 in order to allow easy stacking of the palletized loads with a conventional forklift. The preferred stacking arrangement is that is shown in FIG. 6. However, in certain prior art situations as shown in FIG. 5 not utilizing the invention, a stack of pallets or array of trays 48 can create an angular displacement, such as a result of the compression of the tray 50 in combination with the freely moving cans 52. Moist, hot and humid weather contributes to the potential of this compression of the base of a tray.

Modification to the above described embodiments and methods would be obvious to those of ordinary skill in the art and would not bring the invention so modified beyond the scope of the appended claims.

What is claimed is:

1. A method of creating a packaging system involving providing a corrugated paperboard material, preparing a multipackage of plurality of containers with a flexible ring carrier, embossing the base of the corrugated paperboard material in regions designed to receive bases of the containers prior to association with the containers, so the base is precompressed to eliminate compression by the containers during palletization which would cause instability of the pallet.

2. The method of claim 1 further including the step of forming a side wall in the trays.

3. The method of claim 1 further including the step of arranging a plurality of such trays to create a multi-layer stack of trays.

4. The method of claim 1 wherein the base of the corrugated paperboard material is embossed on a top side of said corrugated paperboard material for receiving bases of the containers and leaving a bottom side of said corrugated paperboard material substantially flat.

* * * * *